US005388819A

United States Patent [19]

Ushirogata

[11] Patent Number: 5,388,819

[45] Date of Patent: Feb. 14, 1995

[54] CLAMPING AND TRANSPORTING DEVICE

[75] Inventor: Yoshiaki Ushirogata, Tokyo, Japan

[73] Assignee: Ricoh Company, Ltd., Tokyo, Japan

[21] Appl. No.: 53,355

[22] Filed: Apr. 28, 1993

[30] Foreign Application Priority Data

Apr. 30, 1992 [JP] Japan ..... 4-111646

[51] Int. Cl.[6] ..... B65H 31/26

[52] U.S. Cl. ..... 271/220; 270/53; 414/790.2

[58] Field of Search ..... 271/85, 220, 221, 252, 271/249, 84; 198/468.2, 468.1, 468.9; 270/37, 52, 53, 58; 355/324; 227/50, 99, 100; 414/790.2, 792.8, 792.9, 796.9

[56] References Cited

U.S. PATENT DOCUMENTS

| | | | |
|---|---|---|---|
| 4,545,715 | 10/1985 | Seefeldt | 414/790.2 X |
| 4,569,622 | 2/1986 | Buck | 414/790.2 X |
| 4,691,817 | 9/1987 | Haar | 198/468.2 |
| 4,971,302 | 11/1990 | Morii et al. | 270/53 |
| 5,024,430 | 6/1991 | Seki et al. | 270/53 |
| 5,031,890 | 7/1991 | Hosai et al. | 270/58 X |
| 5,054,766 | 10/1991 | Seki et al. | 271/221 |
| 5,064,181 | 11/1991 | Hosoi et al. | 270/53 |
| 5,072,920 | 12/1991 | Kubota et al. | 270/53 |
| 5,080,342 | 1/1992 | Mori et al. | 270/53 |
| 5,099,292 | 3/1992 | Hirose | 355/324 |
| 5,121,911 | 6/1992 | Yamazaki et al. | 270/53 |
| 5,137,266 | 8/1992 | Mori et al. | 270/53 |

FOREIGN PATENT DOCUMENTS

| | | | |
|---|---|---|---|
| 0082564 | 5/1985 | Japan | 271/85 |
| 0281258 | 11/1989 | Japan | 270/53 |
| 0276693 | 11/1990 | Japan | 270/53 |
| 0289390 | 11/1990 | Japan | 270/53 |
| 0255396 | 9/1992 | Japan | 270/53 |

*Primary Examiner*—H. Grant Skaggs
*Assistant Examiner*—Carol L. Druzdick
*Attorney, Agent, or Firm*—Oblon, Spivak, McClelland, Maier, & Neustadt

[57] ABSTRACT

A clamping and transporting assembly is provided which is particularly suitable for clamping a stack of articles, such as sheet-like articles. The clamping assembly moves from a retracted position to an extended position at which clamping jaws automatically assume a clamped position. Thereafter, the assembly transports the clamped stack of sheet-like articles to a treatment device, for example a binding device. After treatment, such as binding, the transport assembly returns the articles to their original position, with the clamping assembly then retracted while automatically releasing the articles from the jaws.

14 Claims, 6 Drawing Sheets

CLAMPING AND TRANSPORTING DEVICE

BACKGROUND OF THE INVENTION

1. Field of the Invention

The invention relates to clamping and/or transporting of paper, particularly stacks of paper in which, after a printing or copying operation, the stack of paper is to be transported to a treatment station, such as stapling or binding device. The invention is particularly desirable in the context of a copying or printing machine, in which, after copying, a stack of sheets are received in a bin, with the stack then clamped and transported to a binding device in the clamped condition.

2. Discussion of Background

Often, a copying machine or printing apparatus will include a suitable device for binding or attaching a stack of sheets to one another after completion of the copying or printing process. For example, a stapling device or a perforating/binding device can be provided, with a clamp holding the stack of sheets during the binding operation.

FIG. 7 shows an example of a paper clamping arrangement as disclosed in Japanese Laid-Open Patent Publication No. 2-23154/1990. The clamping apparatus includes a fixed support portion 100, with a clamping assembly designated generally at 110. The clamping assembly 110 can be reciprocated forwardly and backwardly in the direction indicated by arrows and A and B. Mounted upon the support 100 is a motor 101, a pair of gears 102, 103 for reducing the rotational speed of the motor 101 and changing the direction of rotation, as well as a screw or threaded shaft 105 for transmitting the rotation of the motor 101 to the clamping assembly 110 via an intermediate movable bar 104 having a threaded hole therein. As the motor rotates, the shaft 105 causes the bar 104 to translate, thereby causing translation of the clamping assembly 110 connected thereto.

As also shown in FIG. 7, the clamping assembly 110 includes a pair of clamp levers 111, 112 for clamping a stack of sheets which are discharged onto the bin 120 in the direction indicated by arrow C. The upper clamp lever 111 is mounted upon the assembly 110 such that it is movable to effect a clamping operation, while the lower clamp lever 112 is fixed. Further, the upper clamp lever 111 is resiliently biased into a release position via spring 113, with the clamp 111 driven to effect clamping by a solenoid 114. Thus, during actuation of the solenoid, the clamp 111 is moved downwardly, and upon release of the solenoid, the spring 113 causes a release of the clamp.

In operation of the clamping arrangement shown in FIG. 7, the motor 101 rotates in order to rotate the threaded shaft 105, thus moving the bar 104 and clamping assembly 110 to a forward grasping position. Power is then supplied to the solenoid 114, and a stack of sheets located on the bin 120 is clamped by the clamp levers 111, 112. Thereafter, the motor 101 rotates in a reverse direction to retract the clamping assembly to a treatment position at which a stapling or binding operation takes place. The binding apparatus (not shown in FIG. 7) is disposed at the side of the clamp apparatus, and performs the binding operation when the clamping assembly is in the retracted and clamped condition. Thereafter, the motor 101 rotates to advance the clamping assembly, with the solenoid 114 then released, thereby returning the bound stack of sheets to the bin.

The clamping assembly 110 then retreats to a waiting position for the next binding operation.

Although only a single bin 120 is shown in FIG. 7, typically, plural bins are arranged which are parallel to one another, and which are stacked vertically. The clamping apparatus and the subsequent treatment unit (e.g., a binding apparatus) are movable up and down to service the plural bins.

In the arrangement as shown in FIG. 7, a cumbersome design is required since the mounting of the binding apparatus must accommodate for the clamping assembly. The arrangement becomes more inconvenient when it is desirable to bind a stack of sheets at more than one location, since the binding apparatus is required to move from a first binding location to a second binding location, and such movement can be obstructed by the clamping assembly. Accordingly, the clamping arrangement as shown in FIG. 7 severely limits the flexibility of subsequent treatment operations, such as binding operations, or at least, greatly complicates such binding operations. Moreover, the clamping assembly as shown in FIG. 7 is generally only suitable for carrying the stack of sheets in forward and backward reciprocating movement, thereby limiting the options available for placement of the binding apparatus. For example, if the FIG. 7 arrangement were utilized to transport a stack of sheets in a direction perpendicular to arrows A–B, the sheets can become skewed, resulting in an unacceptable bound stack.

Accordingly, an improved clamping and transporting arrangement is needed which can conveniently and reliably transport a stack of sheets from a first location, such as in a bin, to a second location at which a binding operation can be easily effected. Such an arrangement should be capable of securely clamping and moving a stack of sheets, without allowing the sheets to move relative to one another or become jumbled, while being able to present the stack of sheets to a variety of subsequent treatment apparatus, such as a binding device which can bind the stack of sheets at one or more locations. In addition, the clamping and transport assembly should be relatively simple, without requiring numerous driving arrangements and/or control systems to synchronize the various movements required for moving the clamping assembly, effecting a clamping operation, and transporting a clamped stack of sheets to a binding device. Further, the clamping assembly should be capable of sustaining moment forces as the stack of sheets are transported, without allowing any of the sheets of the stack to become skewed which would result in an unsatisfactory binding operation.

SUMMARY OF THE INVENTION

Accordingly, it is an object of the present invention to provide an improved clamping and transporting arrangement which can securely clamp a stack of sheets, and transport the stack of sheets to a subsequent treatment unit, for example a binding device.

It is a further object of the present invention to provide a clamping arrangement which provides sufficiently reliable clamping, such that, despite moment forces acting upon a stack of sheets, the sheets do not become skewed with respect to one another during transport, such that a satisfactory bound stack of sheets can be formed.

It is a further object of the present invention to provide a clamping and transporting assembly in which compound movements of the assembly, for example a translating movement of the assembly and a clamping movement of the clamping jaws, can be accomplished utilizing a single motor.

It is yet another object of the present invention to provide a clamping and transporting assembly in which a pair of clamping jaws are provided, with the operation of the jaws synchronized, such that the clamps simultaneously perform a clamping operation upon reaching a predetermined position at which a stack of sheets is located.

It is a still further object of the present invention to provide a clamping and transporting arrangement in which one or more clamping jaws is reciprocable in a first direction in order to move the assembly to and from a clamping position, with the assembly also movable in a direction perpendicular thereto, such that, after clamping, the assembly transports the clamped stack of sheets to a binding location. Utilizing such an arrangement greatly simplifies mounting of a binding device and the clamping device while maintaining compactness of the overall design, for example, in the context of a copying machine. In addition, the flexibility of the binding operation is improved, such that binding at more than one location can be readily accomplished without requiring complex movement of the binding device or the clamp.

These and other objects and advantages are achieved in accordance with the present invention in which a pair of clamping jaws are provided, which reciprocate to move from a waiting position to a clamping position at which the pair of jaws clamp a stack of sheets located in a bin, for example a discharge bin of a copying apparatus. In accordance with a preferred arrangement, the same motor which is utilized for effecting the reciprocating movement of the jaws also effects clamping of the jaws, by virtue of the linkage or coupling arrangement utilized for moving and controlling movement of the clamping jaws. Additionally, a transport and guide assembly are provided, such that after clamping the stack of sheets, the clamping jaws are transported, preferably in a direction perpendicular to the reciprocating direction, such that the stack of sheets is conveniently presented to a subsequent treatment device, such as a binding device. By utilizing a pair of clamping jaws, moment forces associated with such transport are readily accommodated, thus avoiding any skewing of the sheets, even though the sheets are clamped only at a side of the stack.

In addition, by transporting the stack parallel to the discharge direction of the sheets and perpendicular to the advancing/retracting direction of the clamp, greater access is provided to the stack for binding, such that binding at plural locations on the stack can be easily accomplished.

BRIEF DESCRIPTION OF THE DRAWINGS

The above, as well as additional objects and advantages of the present invention will become readily apparent from the following detailed description, particularly when considered in conjunction with the drawings in which.

DETAILED DESCRIPTION OF THE PREFERRED EMBODIMENTS

Figure 1:
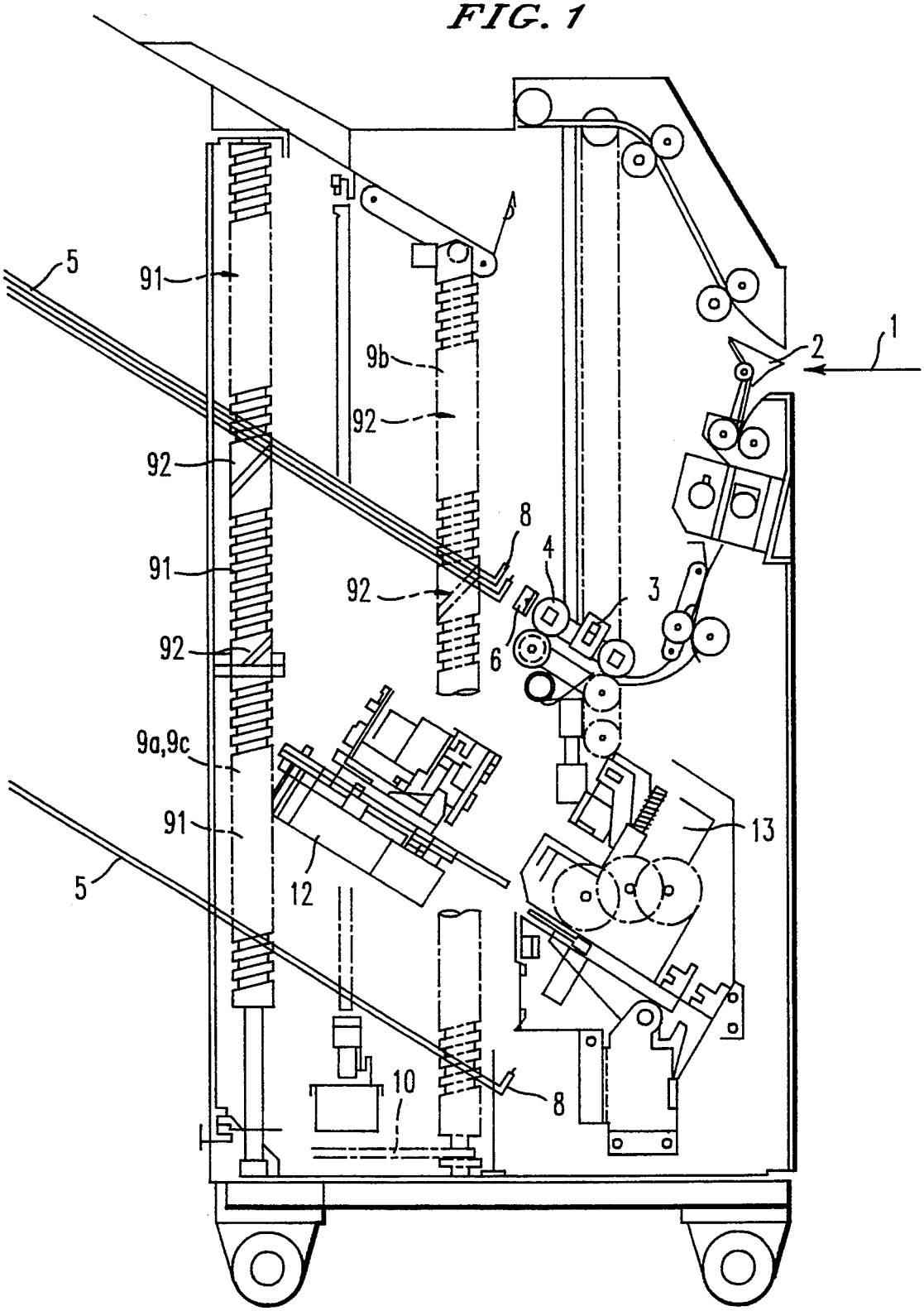
FIG. 1 shows a side view of a discharge portion of a copying apparatus, including plural bins, with a clamping unit and binding unit.

Referring briefly now to FIG. 1, a discharge portion of a copying apparatus is shown. Although the clamping and transport arrangement of the present invention is particularly desirable in the context of a copying machine or printing apparatus, it is to be understood that the clamping and transport assembly can be advantageously utilized wherever it is desirable to clamp and transport articles, particularly a stack of sheet-like articles. As shown in FIG. 1, after completion of a printing or copying operation, sheet-like articles will enter the discharge or storage compartment at the location indicated by arrow 1. The sheets will then travel through a guide path 2, with a suitable discharge arrangement 3 provided for forwarding the sheets into bins 5. The bins 5 are movable vertically utilizing a motorized shaft arrangement *9a, 9b, 9c,* with spiral/threaded portions 91 and helical portions 92. A driven belt 10 is utilized for moving the shaft arrangements, thereby providing vertical movement of the plural bins, as well as providing a separation of the bins with respect to one another. Such an arrangement is conventional, and allows for receipt of sheets in the respective bins, for example in a collating operation. As the sheets are discharged, sensor 6 allows coordination of the movement of the bins, and also can control a jogger bar (not shown) which can assist the sheets discharged into the bins 5 in assuming an organized, stacked condition, with the bins 5 inclined such that the sheets are aligned against a gate or fence member 8.

As also shown in FIG. 1, in accordance with the present invention, an advantageous clamping assembly 12 is provided, with the assembly 12 clamping stacks which have been deposited in the bins, and transporting the stacks to a treatment assembly, for example a binding or stapling device 13. The clamping assembly 12 and binding device 13 are movable vertically in order to service the respective bins. As shown in FIG. 1, and as will become apparent hereinafter, the movement from the clamping assembly 12 to the binding device 13 is parallel to the discharge direction of the sheets passing from the discharge device 3 into the bins 5, with the direction of movement from the clamping assembly 12 to the binding device 13 also parallel to the inclination of the bins 5. The gate or fence 8 is hinged and movable in a conventional manner, thereby allowing the stack of sheets to be moved in a direction parallel to the bin and toward the binding device 13.

In the initial waiting position, the clamping jaws of the clamping assembly 12 do not interfere with the discharge of the paper. After the stacks of paper or stacks of copy sheets are formed, the clamping jaws move in a direction which is into the page of drawing FIG. 1 in order to clamp the stack of sheets, and thereafter the clamping assembly moves rightwardly and downwardly (parallel to the inclination of the bins 5 and parallel to the discharge direction of the sheets) to allow for a binding operation by the binding device 13. By contrast, in the prior art arrangement discussed earlier with reference to FIG. 7, the clamping device moved in an upward-leftward direction (the FIG. 1 direction corresponding to arrow A in FIG. 7) to grasp a stack of sheets, and then moved downward-rightward (the direction corresponding to arrow B in FIG. 7) in a retracting movement to present the stack of sheets to a binding device. In comparison with the arrangement of the present invention, the prior art arrangement provides a cumbersome design, since the clamping assembly 100 is located adjacent to the binding device, and operations requiring binding at more than one location on a stack were either not possible, or required a complicated movement of the binding device to access more than one location of a stack of sheets being clamped by the clamping assembly.

Figure 2:
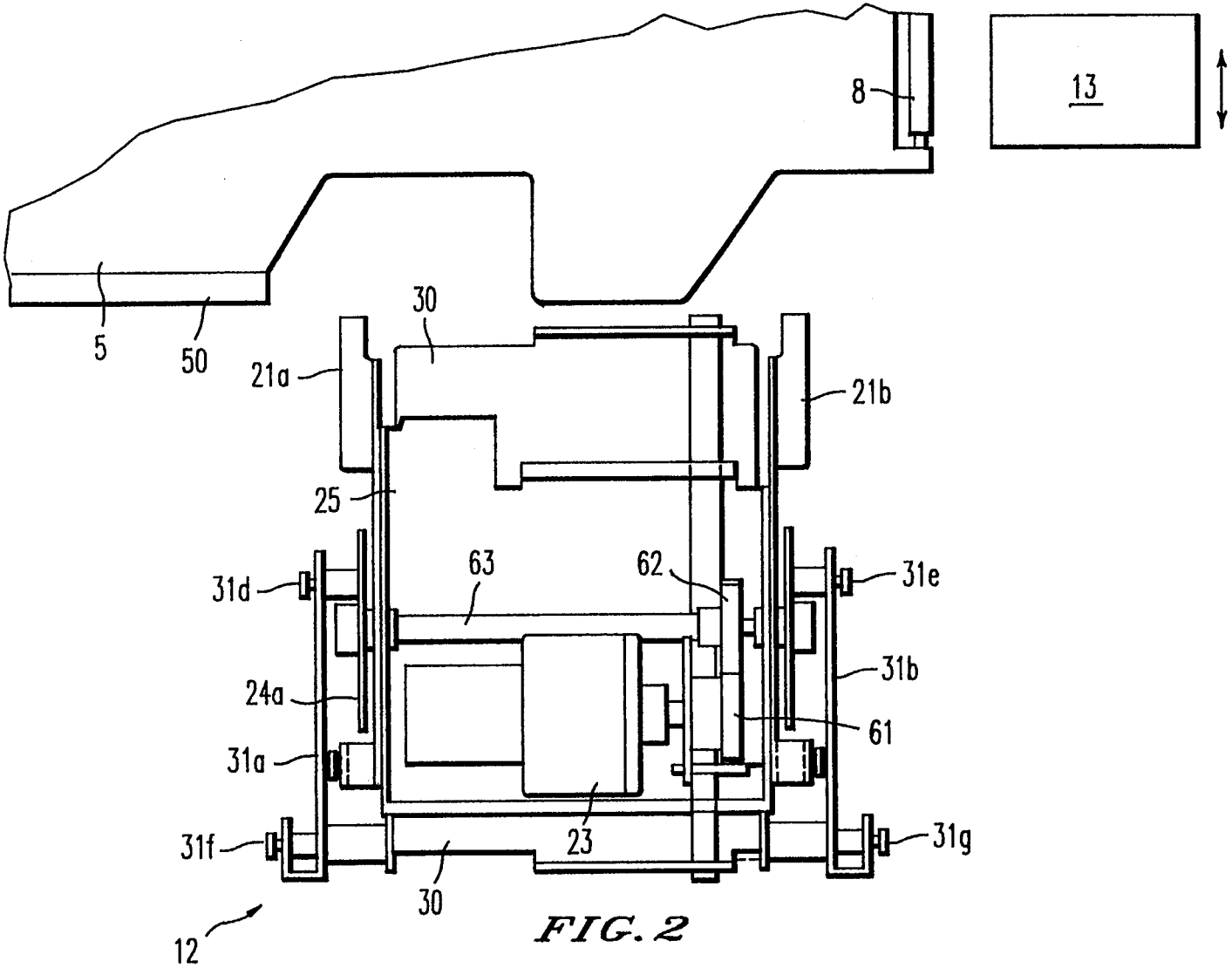
FIG. 2 shows a plan view of a clamping, transporting and binding arrangement of the present invention.

Referring now to FIG. 2, a plan view of the clamping assembly 12 is shown. In accordance with one aspect of the present invention, by providing movement which is parallel to the bins, but which is in a direction different from that of the extending/retracting movement of the clamping jaws from a waiting position to a clamping position, convenient access of the binding device to the clamped stack is attained. In addition, as shown in FIG. 2, a pair of clamping jaws are provided, with the upper lever of each jaw shown at 21*a*, 21*b*. By providing a pair of jaws which are synchronously operated, the stack of sheets can be transported rightwardly while grasping only one edge of the sheets, however, as a result of the firm clamping engagement, any moment forces which may act upon the stack are accommodated without encountering any skewing of the sheets of a stack with respect to one another. As will become more readily apparent hereinafter, the clamping jaws 21*a*, 21*b* initially move from a retracted position to an extended position (movement toward the top of the drawing in FIG. 2) such that a stack of sheets which is received by the bin 5 can be clamped. The stack of sheets is aligned by surfaces 50 and 8 in the bin. As discussed earlier, the fence of guide 8 is movable by known means. After clamping the sheets, the gate 8 is released, and the clamping assembly transports the stack of sheets rightwardly (or rightward-downward in the FIG. 1 view), thereby providing convenient access of the stack of sheets to the binding device 13. Typically, the binding device 13 is also movable, such that when the stack is presented, the binding device moves to effect a binding operation at one or more locations. The clamping assembly of the present invention includes a frame structure designated generally at 25 which is movable in the extending/retracting direction, and a frame 30 which is movable in the transport direction. A motor 23 is disposed within the support arrangement, with the motor 23 controlling the reciprocating (top to bottom and vice versa with respect to FIG. 2) and clamping movement of the clamping jaws.

Figure 3:
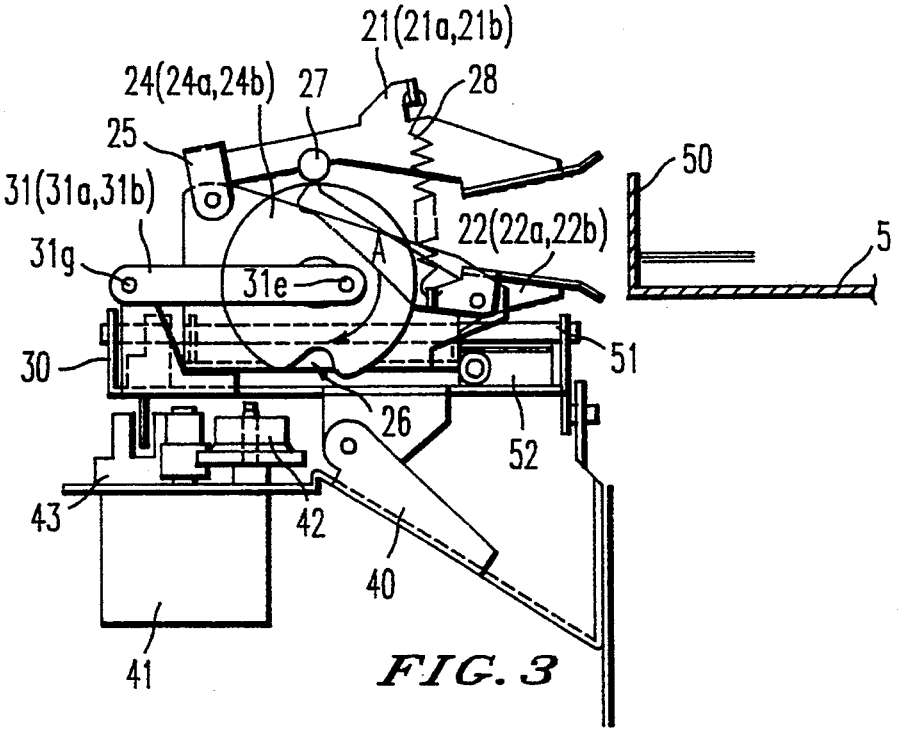
FIG. 3 shows a side view of the clamping assembly shown in FIG. 2, with the clamping unit in the retracted, unclamped condition.

Operation of the clamping assembly will become more readily apparent with reference to FIGS. 3–6. FIG. 3 shows the clamping assembly in the retracted, unclamped condition. As shown in the side view of FIG. 3, the upper portion of the clamping jaws 21 are pivotally mounted on the frame structure 25, with a spring 28 biasing the clamps in a closed position. However, a cam follower 27 is mounted upon the lever section or lever member of the upper potion of the clamping jaw, and rides upon a cam 24*b*. As will be appreciated, similar structure is provided for the opposite side clamping jaw 21*a*.

Briefly, referring back to FIG. 2, operation of the motor 23 causes rotation of gears 61, 62, with the gear 62 mounted upon a shaft 63, such that rotation of the motor results in rotation of the shaft 63 at a desired speed. Respective cams 24*a*, 24*b* are mounted upon the shaft 63, such that the cams 24*a*, 24*b* rotate together in synchronism.

As shown in FIG. 3, the support frame arrangement 25 is movable, while the lower support frame 30 is fixed (i.e. with respect to the extension/retraction movement), and includes a guide shaft 51 and rail 52, with suitable rollers or bearings provided such that the movable frame 25 is allowed to reciprocate along the fixed frame 30. As discussed earlier, rotation of the motor mounted within the frame 25 causes rotation of the cams 24*a*, 24*b*. Respective crank arms 31 are connected to the cams via respective eccentrically mounted pivot pins 31*d*, 31*e*. At their opposite ends, the crank arms are also pivotally mounted to the frame 30 as shown at 31*f*, 31*g*. As a result of the mounting of the crank arms to a fixed pivot point on the frame 30, as well as the eccentric mounting upon the cam, as the cam rotates, the movable frame assembly 25 translates, thereby providing the reciprocating movement of the clamping jaws, such that the clamping jaws can be moved from a waiting (retracted) position (FIG. 3) to a clamping (extended) position (FIG. 4).

Figure 4:
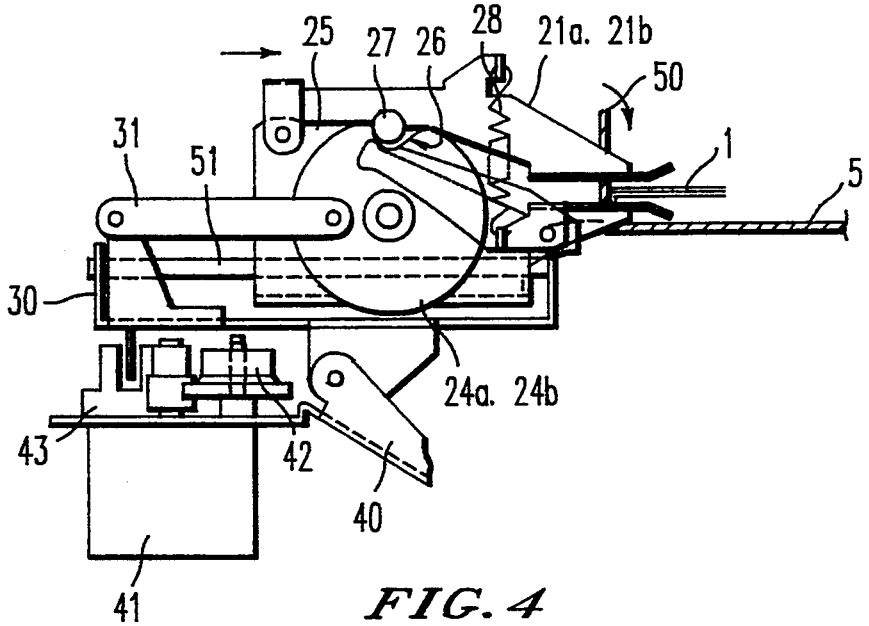
FIG. 4 shows the clamping unit of FIG. 3, in the extended, clamped condition.

Further, as shown in FIG. 4, the cams 24*a*, 24*b* include a depression or concave portion 26, such that as the movable frame 25 reaches the extended position, the follower 27 falls into the depression 26, thereby causing clamping of the jaws upon the stack of sheets 1. Thus, as should be readily apparent, in accordance with the present invention, the single motor operates the cams 24*a*, 24*b*, with the cams providing both a link in the translating movement of the clamps, as well as providing for actuation of the clamp at the desired extended position. In addition, it should be noted that the concave portion 26 is relatively steep, such that a relatively rapid clamping is provided. Further, since the translating speed of the clamping assembly varies sinusoidally (i.e., as should be readily apparent, the speed of the clamp is greatest when the eccentric pin 31*e* is at the lowermost position), the translating movement is slowed prior to the follower 27 entering the concave portion 26. Thus, as should be readily apparent from a comparison of FIGS. 3 and 4, operation of the motor 23 causes rotation of the cams 24*a*, 24*b*, such that as the cam rotates from the FIG. 3 position in the direction of arrow A, the movable frame assembly 25 moves rightwardly, and after 180° rotation, a clamping operation is performed as shown in FIG. 4. Similarly, as would be readily understood by those skilled in the art, continued rotation of the cam (or reverse rotation of the cam by the motor as desired causes the clamp to open and return to the retracted position.

Figure 5:
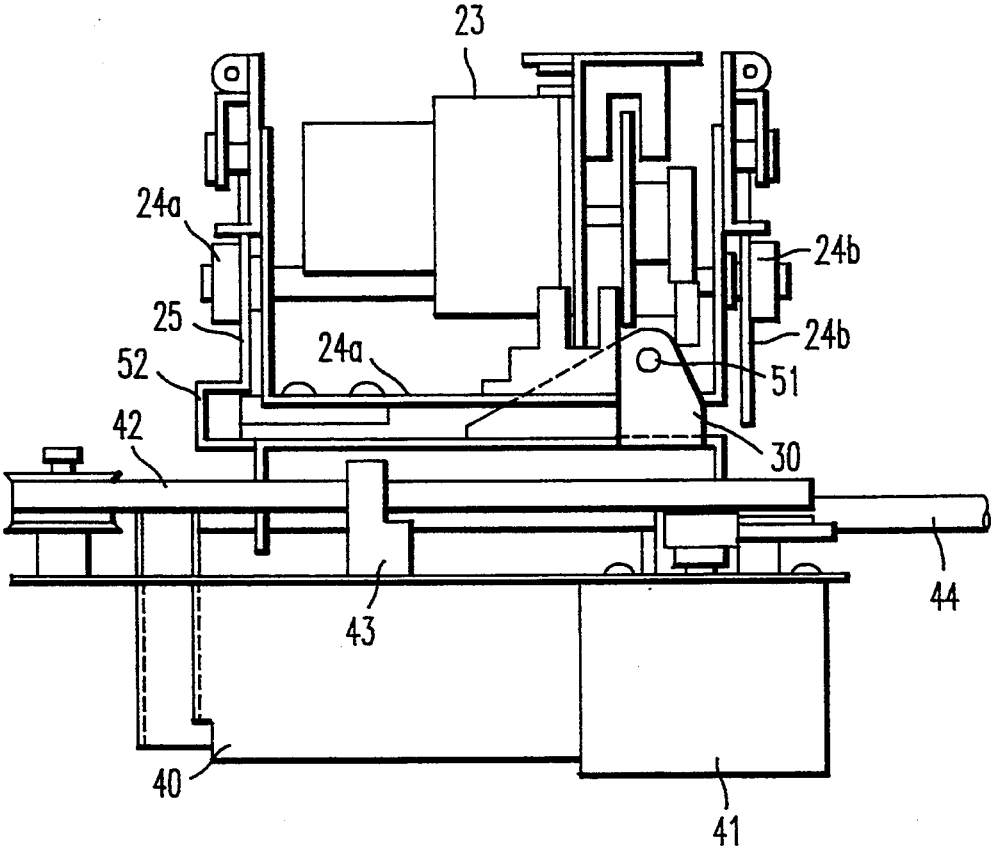
FIG. 5 is a rear view of the clamping assembly shown in FIG. 4 (i.e., as viewed from the left-hand side of FIG. 4, with the rear view shown facing outwardly in FIG. 1)
Figure 6:
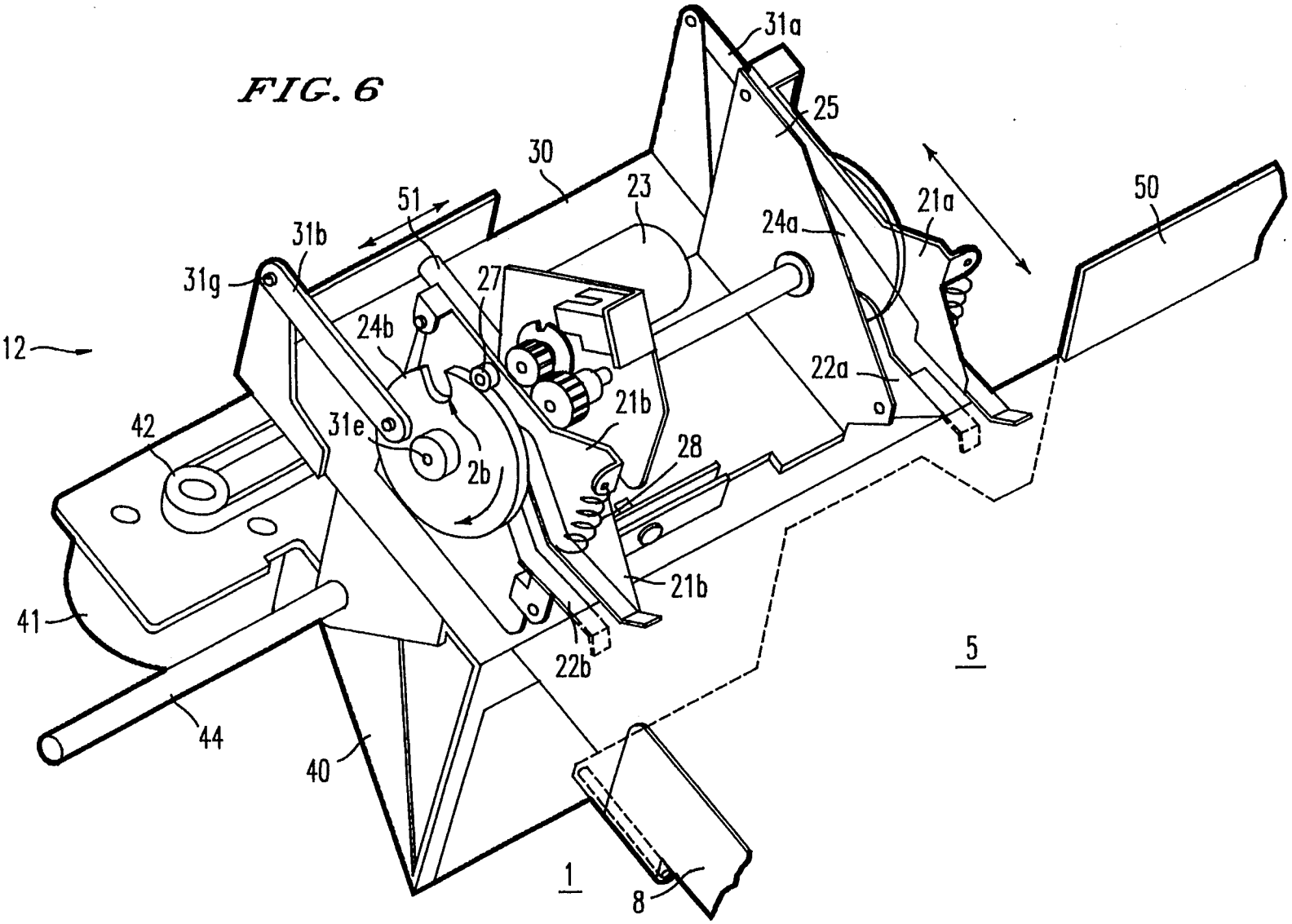
FIG. 6 shows a perspective view of the clamping and transport assembly of the present invention.

After the clamping jaws have advanced and clamped a stack of sheets, a stepping motor 41 begins operation to perform the transporting of the sheets such that the sheets are readily accessible to a binding device 13 (FIG. 2). As shown in FIGS. 5 and 6, the motor 41 causes rotation of a belt member 42 which is connected to the frame assembly 30, such that the frame 30 travels along a guide rod 44. In addition, a sensor 43 is provided for detecting various positions of the clamping and transport assembly. The motor 41, timing belt and sensor 43 are mounted upon a support 40. The sensor can, for example, sense different positions or indicia of the belt 42, thereby precisely controlling the transporting and return functions. For example, the belt can include a first indicia indicating that the motor 41 has advanced the clamping assembly to the binding device. After completion of the binding operation, the motor will operate in a reverse direction, thereby causing return of the clamping assembly (e.g., to the left in FIG. 5) to the location at which the clamping assembly initially retrieved the stack of sheets. In a preferred mode, the motor 41 will over-travel on the return movement, and thereafter will reverse to cause movement in the forward direction, with the sensor indicating a bin stop location as the motor 41 moves forward after the over-travel movement, thereby allowing precise return movement of the stack of sheets to the bins 5 after completion of the binding operation. The bound stack of sheets can thus be retained in the bin 5, with the gate 8 then raised. Thereafter, the motor 23 rotates to retract the frame assembly 25, while simultaneously causing an opening of the jaws, as the clamping assembly moves from the FIG. 4 position to the FIG. 3 position.

Thus, the present invention provides a relatively simple arrangement which provides for reliable clamping and transport of a stack of sheets, such that the stack of sheets are readily accessible to a subsequent treatment device, such as a binding device. In operation, with reference to FIG. 2, the motor 23 will rotate to cause the frame assembly 25 and clamping jaws to move to the extended position (toward the top of FIG. 2), and as the jaws reach the extended position, the jaws clamp the stack of sheets disposed in the bin 5. Thereafter, the motor 41 (e.g., FIG. 6) operates to cause transport of the clamping assembly to the right in FIG. 2, thereby making the stack of sheets readily accessible to the binding device 13. After completion of the binding operation, the clamping assembly moves leftward with reference to FIG. 2, and the bound sheets are deposited upon the bin 5. The motor 23 then moves in a reverse direction, thereby causing opening of the jaws and retraction of the jaw assembly to a waiting position for a next binding operation.

Figure 7:
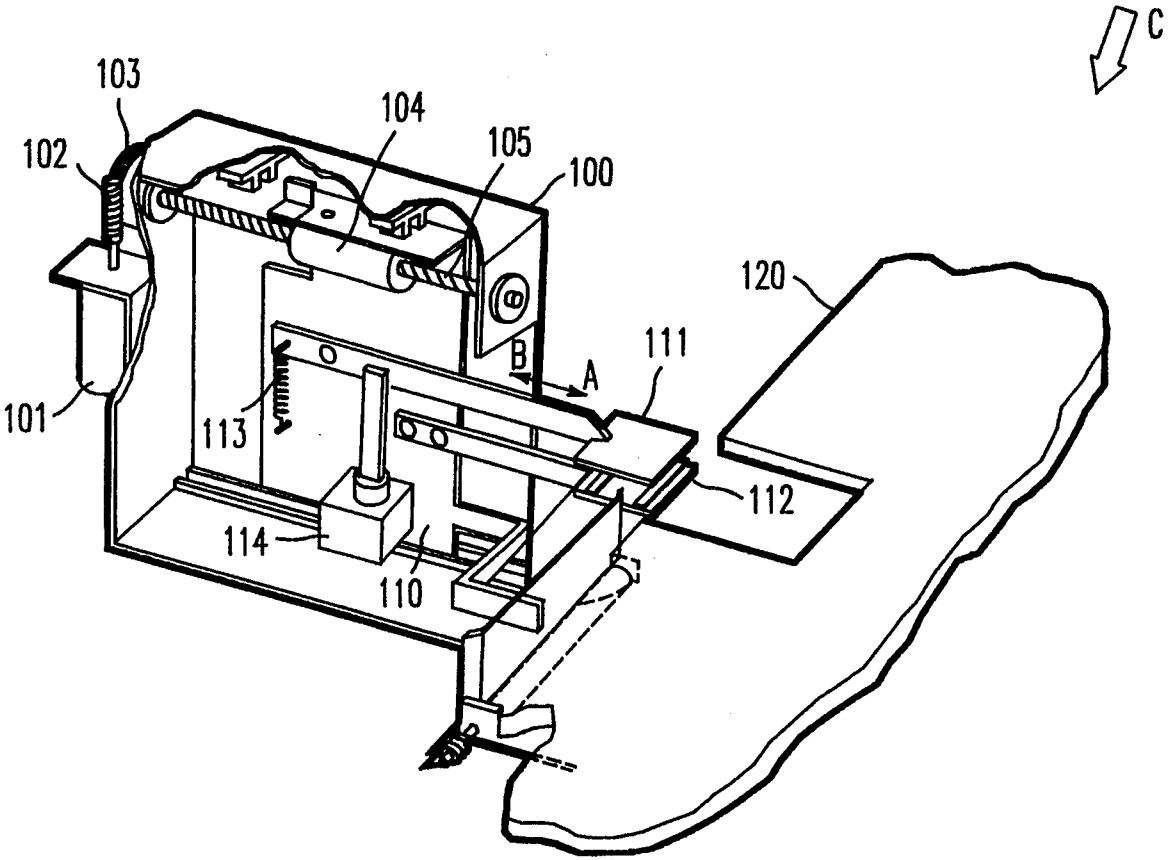
FIG. 7 PRIOR ART
FIG. 7 shows a conventional clamping assembly.

The use of a pair of clamping jaws provides for firm clamping of the sheets, such that the sheets are not skewed during transport. For example, utilizing an arrangement as shown in FIG. 7, if the stack of sheets were to be transported in a direction perpendicular to the reciprocating direction of the clamp, the sheets could readily become skewed. By contrast, in accordance with the present invention, a pair of synchronized clamps hold the paper as it is transported in a direction parallel to the discharge direction of the sheets, and perpendicular to the reciprocating movement of the movable frame assembly 25. In addition, utilizing the cam members **24*a*, 24*b*, which simultaneously act as both a cam for controlling the jaw actuation, as well as a linkage in the translating (extension/retraction) movement, a single motor can be utilized for operating both the reciprocating movement of the assembly 25, as well as the clamping of the jaws, while ensuring that the operations are coordinated with respect to one another. Furthermore, the depression or recess in the cam provides for rapid and firm clamping as the extension movement is completed, with the steep surface of the recess also assisting in maintaining the clamped position until the motor 23** starts the retracting movement.

Obviously, numerous modifications and variations of the present invention are possible in light of the above teachings. It is therefore to be understood that within the scope of the appended claims, the invention can be practiced otherwise than as specifically described herein.

What is claimed as new and desired to be secured by letters patent of the United States is:

1. A paper clamping device comprising:

a clamping jaw movable between opened and closed conditions, and movable between extended and retracted positions;

a motor;

a linkage assembly connected to said motor such that operation of said motor causes movement of said clamping jaw between the extended and retracted positions;

wherein said linkage assembly also causes movement of said clamping jaw between said opened and closed conditions and wherein said linkage assembly includes a cam, said cam including a recessed portion, and wherein said clamping jaw includes a follower which rides upon a surface of said cam, and said clamping jaw is moved to a closed position when said follower enters said recessed portion.

2. The clamping device of claim 1, wherein said clamping jaws and said cam are mounted on a movable first frame, and wherein a pivotable arm is mounted upon a second frame, said pivotable arm also connected to said cam via a pin at an eccentric location of said cam, such that rotation of said cam causes movement of said first frame with respect to said second frame, thereby moving said jaw between the retracted and extended positions.

3. The clamping device of claim 1, further including a second clamping jaw movable between opened and closed conditions, and between extended and retracted positions in synchronism with the first mentioned jaw, wherein movement from the retracted position to the extended position is in a first direction;

the clamping device further including transport means for moving said clamping jaws in a second direction perpendicular to said first direction.

4. A paper clamping device comprising:

a clamping jaw movable between opened and closed conditions, and movable between extended and retracted positions;

a motor;

a linkage assembly connected to said motor such that operation of said motor causes movement of said clamping jaw between the extended and retracted positions, wherein said linkage assembly includes a cam mounted upon a movable first frame, and wherein a pivotable arm is mounted upon a second frame, said pivotable arm also pivotally connected to said cam at an eccentric location, such that rotation of said cam causes movement of said first frame with respect to said second frame, thereby moving said jaw between the retracted and extended positions, and wherein said cam also includes a recess, said jaw including a follower mounted thereon which travels along an outer periphery of said cam, wherein said clamping jaw is moved to the closed condition when said follower enters said recess.

5. The assembly of claim 4, wherein movement of said clamping jaw from the retracted to the extended position is in a first direction, said clamping device further including means for transporting said clamping jaw in a second direction perpendicular to said first direction.

6. An apparatus for clamping and transporting a plurality of sheet-like articles wherein said sheet-like articles are discharged in a first direction into a bin, and wherein a clamping device clamps said articles and transports said articles to a subsequent treatment device, the apparatus comprising:

means for sequentially discharging sheet-like articles in said first direction into said bin to thereby form a stack of sheet-like articles in said bin;

a pair of clamps;

transport means for transporting said pair of clamps in a transport direction which is parallel to said first direction in which said sheet-like articles are discharged into said bin to thereby transport a clamped, stack of sheet-like articles from said bin;

the apparatus further including means for extending and retracting said pair of clamps between extended and retracted positions, wherein said retracted position corresponds to a waiting position during which sheet-like articles can be discharged into the bin, and said extended position corresponds to a position at which the pair of clamps clamp a stack of sheet-like articles disposed in the bin, and Wherein a direction of movement from the retracted position to the extended position is perpendicular to the transport direction, the apparatus further including means for closing said pair of clamps as said clamps reach the extended position, and wherein said means for closing said clamps includes a cam having a notch therein, said cam also acting as a linkage in the means for moving the clamps between the retracted and extended positions.

7. A clamping device comprising:

a plurality of pairs of jaws, each pair forming a clamp;

a motor for operating opening and closing of said jaws;

a linkage assembly connected to said motor and to said jaws to effect opening and closing of said jaws simultaneously, wherein each of said pairs of jaws are mounted upon a first frame, and wherein said linkage assembly includes a plurality of cams, one cam associated with each pair of jaws, wherein said motor effects rotation of said cams, and wherein rotation of said cams causes movement of said jaws between extended and retracted positions, and further wherein a recessed portion of each said cam causes closing of said jaws at a predetermined angular position of said cams.

8. The clamping device of claim 7, wherein said clamping device is mounted adjacent a bin which receives sheet-like articles, and wherein said sheet-like articles are discharged into said bin in a first direction, said clamping device further including means for transporting said plurality of pairs of jaws in a transport direction which is parallel to said discharge direction.

9. The clamping device of claim 8, wherein the direction of movement of said plurality of pairs of jaws between the extended and retracted positions is perpendicular to the transport direction.

10. A clamping device comprising:

at least one pair of jaws constituted by an upper jaw and a lower law;

means for moving said pair of jaws in a first direction between a first retracted condition and a second extended condition;

means for moving said pair of jaws between opened and closed conditions such that when said pair of jaws are in the first retracted condition said jaws are in the opened condition and when said jaws are in the extended condition said jaws are in the closed condition; and means for transporting said pair of jaws in a second direction when said jaws are in the second extended condition and in the closed condition, wherein said second direction is not parallel to said first direction.

11. The clamping device of claim 10, wherein said second direction is perpendicular to said first direction.

12. A clamping device comprising:

a clamp movable between opened and closed conditions;

a motor for operating opening and closing of said clamp;

a linkage assembly connected to said motor and to said clamp to effect opening and closing of said clamp; and wherein said clamping device is mounted adjacent a bin which receives sheet-like articles, and wherein said sheet-like articles are discharged into said bin in a first direction, said clamping device further including means for transporting said clamp in a transport direction which is parallel to said discharge direction.

13. A paper clamping device comprising:

first and second clamps each movable between opened and closed conditions;

a motor;

a rod drivingly coupled to said motor and extending between said first and second clamps, said rod coupled to first and second cams;

first and second followers respectively associated with said first and second clamps, said first and second followers respectively riding on outer peripheries of said first and second cams such that said cams effect opening and closing of said clamps.

14. The paper clamping device of claim 13, further including a crank arm having a first end connected to one of said cams at an eccentric location, said crank arm further including a second end fixed to a frame, whereby rotation of said one of said cams causes translational movement of said one of said cams.

* * * * *